US010385586B2

(12) United States Patent
Maiero et al.

(10) Patent No.: US 10,385,586 B2
(45) Date of Patent: Aug. 20, 2019

(54) METHOD FOR AN EMERGENCY OPENING OF A DOOR LOCKING DEVICE OF A LAUNDRY WASHING AND/OR DRYING APPLIANCE

(71) Applicant: Electrolux Appliances Aktiebolag, Stockholm (SE)

(72) Inventors: Marco Maiero, Codroipo (IT); Sergio Blancuzzi, Porcia (IT)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 668 days.

(21) Appl. No.: 14/805,106

(22) Filed: Jul. 21, 2015

(65) Prior Publication Data

US 2016/0024814 A1 Jan. 28, 2016

(30) Foreign Application Priority Data

Jul. 22, 2014 (EP) ..... 14178006

(51) Int. Cl.
*E05B 17/00* (2006.01)
*D06F 39/14* (2006.01)
(Continued)

(52) U.S. Cl.
CPC ..... *E05B 17/005* (2013.01); *D06F 37/28* (2013.01); *D06F 39/14* (2013.01); *D06F 58/04* (2013.01); *E05B 65/00* (2013.01); *E05C 19/12* (2013.01)

(58) Field of Classification Search
CPC ..... E05B 35/008; E05B 2047/0086; E05B 17/005; E05B 65/00; E05C 19/12;
(Continued)

(56) References Cited

U.S. PATENT DOCUMENTS 4,088,354 A * 5/1978 Kolendowicz ..... E05B 47/0603 292/201
6,603,377 B2 * 8/2003 Cho ..... D06F 37/42 335/185

(Continued)

FOREIGN PATENT DOCUMENTS

DE 3006307 A1 8/1981
EP 1972714 A1 * 9/2008 ..... D06F 37/28

(Continued)

OTHER PUBLICATIONS

Sep. 5, 2017 U.S. Non-Final Office Action—U.S. Appl. No. 14/805,754.

*Primary Examiner* — Christine M Mills
(74) *Attorney, Agent, or Firm* — Ratnerprestia

(57) ABSTRACT

A method is provided for an emergency opening of a door locking device (1) of a door (4) of a laundry washing and/or drying appliance (100). The method includes, inserting a tool (40; 50) in the cabinet (3) of the appliance until the tool (40; 50) interacts with a safety member (53) moving the latter into a retracted position; operating a moveable handle (5) of the door and keeping it operated in such a way as to try to move a hook member (21) to an opening position, so that the hook member does not prevent a retaining member (54) from moving towards a rest position; removing the interaction between the tool (40; 50) and the safety member (53); and removing the hook member (21) from the opening (22).

11 Claims, 9 Drawing Sheets

(51) Int. Cl.

| | |
|---|---|
| ***D06F 37/28*** | (2006.01) |
| ***E05B 65/00*** | (2006.01) |
| ***E05C 19/12*** | (2006.01) |
| ***D06F 58/04*** | (2006.01) |

(58) Field of Classification Search

CPC ..... D06F 37/28; D06F 39/14; D06F 58/04; D06F 37/42; Y10T 292/0908; Y10T 292/0909; Y10T 292/0945; Y10T 292/0956; Y10T 292/03; Y10T 292/1043; Y10T 292/1051; Y10T 292/1052; Y10T 292/1075; Y10S 292/65; Y10S 292/69

USPC ... 292/92, 93, 96, 106, DIG. 65, DIG. 69, 1, 292/194, 219, 220, 195

See application file for complete search history.

(56) References Cited

U.S. PATENT DOCUMENTS

| | | | | |
|---|---|---|---|---|
| 9,416,568 | B2 * | 8/2016 | Promutico | D06F 37/42 |
| 2011/0083476 | A1 | 4/2011 | Yang | |
| 2016/0286958 | A1 * | 10/2016 | Cinello | D06F 39/02 |

FOREIGN PATENT DOCUMENTS

| | | | |
|---|---|---|---|
| EP | 2159316 | A1 | 3/2010 |
| EP | 2251479 | A1 | 11/2010 |

* cited by examiner

METHOD FOR AN EMERGENCY OPENING OF A DOOR LOCKING DEVICE OF A LAUNDRY WASHING AND/OR DRYING APPLIANCE

CROSS-REFERENCE TO RELATED APPLICATION

This application claims priority to European Application No. 14178006.4, filed on Jul. 22, 2014, the content of which is hereby incorporated by reference in its entirety.

TECHNICAL FIELD

The present invention is related to a method for opening a laundry washing and/or drying appliance, in particular the present invention refers to a method for an emergency opening of a laundry washing and/or drying appliance provided with an electrically powered door locking device which cannot be electrically operated in case of power failure or lack of electrical power supply to the same.

Throughout the present description and the following claims, the expression "emergency opening" is used to refer to a forced opening which becomes necessary in case the opening of the appliance is prevented even though the handle is operated, namely in case of power failure or lack of electrical power supply to the door locking device of the appliance.

BACKGROUND ART

The drum (or operating chamber) of known front loading or top loading laundry washing machines and washer-dryers is accessible by an access opening provided in the cabinet of the machine and closable by a door, for example hinged to the cabinet.

The door is provided with a closing hook, called also "hook member" or simply "hook", that engages with an electro-mechanical door locking device mounted internally to the cabinet and arranged in such a way to be accessible by the hook when the door is in the closed position. The closing hook is part of a mechanical lock which is operable by means of a handle by the user.

When the door is in the closed position, the hook protrudes from the surface of the door facing the cabinet of the appliance, and it is hinged to the door and positioned in such a way to enter into a corresponding opening provided in the door locking device and accessible from outside the cabinet via a corresponding through opening formed in the cabinet.

The hook is urged, for example by means of a spring, towards the border of the opening of the door locking device in a closing position in which it keeps the door fixed to the cabinet; the door handle is mechanically connected to the hook and it is arranged in such a way to move it from above closing position to an opening position in which the hook does not match the border of the opening of the door lock, so as to allow the opening of the door.

The electro-mechanical door locking device generally comprises a mechanism for the instantaneous interlock and/or delayed release of the door, called the door interlock, which has the function of preventing opening of the door after the machine has been started and/or of delaying opening thereof at the end of the working cycle, for example to ensure that the inertial rotation of the drum has ceased, or that the inner temperature has decreased enough.

The electro-mechanical door locking device comprises a retaining member which is coupled in a sliding manner to a support housing of the door locking device. The retaining member is mounted to move with respect to the support housing between a rest position in which it enables the hook member to be introduced into and extracted from the opening of the door lock, and an operating position in which it retains the hook member in a closing position, when the hook member is introduced into the opening of the door lock.

In addition, the door locking device generally includes a safety member, e.g. a safety pin, a safety member which can move in the support housing between a retracted position, in which it enables the retaining member to move from the operating position to the rest position, and an extended position, in which it prevents the retaining member from moving from the operating position to the rest position.

This door locking device is controlled by electronics which need power supply in order to operate properly. In other words, in case of a sudden or not foreseen lack of electric supply, if the door locking device is in a locked status preventing the opening of the door, it remains in such a status till the power supply is available again. In details, if a power failure occurs when the safety member keeps the door locking device in its locked configuration, there is no way of opening the appliance door without damaging the door locking device forcing the same.

It is well known that such emergency conditions occur. In these situations, it is therefore necessary to act from outside the appliance in order to open the door locking device if it is in a closed state with the door of the appliance closed on the cabinet.

Some emergency openings are known in the art. For example, an emergency opening is made by intervention of the maintenance service, opening the appliance and/or lifting the same in order to access an unlocking mechanism of the door locking device, which is actuated by a cord or the like provided within the appliance.

Examples of known documents describing household appliances provided with door locking emergency openings are as follows.

DE 3006307 in the name of Miele & CIE describes a washing machine which includes a safety unlocking device for opening the door, provided at the boundary of the same, under the ring. The unlocking is actuated by the insertion of a tool between the door ring and the front wall of the washing machine.

EP 2159316 in the name of the Applicant describes a laundry washing machine having a safety lock device being fixed to the first wall aligned with the first opening, and having a latch element between an unlock position in which said latch element does not engage the catch element, and a lock position in which said latch element engages the catch element fitted into the first through opening; the manual release of the door from the machine casing being subordinated to the movement of said latch element from the lock position back to the unlock position and the safety lock device also having an axially movable lock pin, which is movable between an extracted position in which the lock pin engages the body of the latch element to prevent the latch element from returning into its unlock position, and a withdrawn position in which the lock pin does not engage the body of the latch element and allows free movement of the latch element; the first wall of the casing having a safety through opening by which to insert an emergency-opening tool inside the machine casing to force the lock pin from the extracted position to the withdrawn position.

EP 2251479 in the name of Bitron S.p.A. relates to a household appliance provided with a door, comprising a door-locking device of the kind provided with an element for permitting activation of emergency opening of said door, and an emergency opening system for said door-locking device, said household appliance being characterised in that it provides a slot, realized on its outer wall, and in that said system comprises a tool, that can be inserted through said slot until interacting with said element in order to permit activation of the system for emergency opening of said door.

SUMMARY OF SELECTED INVENTIVE ASPECTS

The present invention relates to a method of an emergency opening of a door locking device of a door of a laundry washing or drying appliance which is operated by electrical power supply in case of "emergency", in other words, in case of a malfunctioning or absence of the electrical power supply.

Applicant has realized that the emergency openings of the state of the art are not devoid of drawbacks.

For example, in case of accidental insertion of the above described prior art tool into the door locking device, for example by a child, the door can be easily opened, for example by accident even if the appliance is still loaded with water or the internal of the appliance is still hot.

The Applicant considered thus the problem of defining a method for an emergency opening of a door locking device of a door of a laundry washing or drying appliance providing a "further security", thereby making an accidental opening, in particular by children, of the appliance door highly improbable.

According to an aspect, the present invention relates to a method for an emergency opening of a door locking device of a door of a laundry washing and/or drying appliance provided with a cabinet containing an operative chamber in which laundry can be loaded/unloaded, said operative chamber being accessible via an access opening provided in said cabinet and closable by said door, said door locking device comprising:

a. a support housing provided internally to said cabinet and comprising an opening, accessible from outside said cabinet, for the introduction of a pivotable hook member connected to the door, said door comprising a movable handle adapted for operating said hook member in such a way to move it from a closing position, in which, when introduced in said opening, it matches a border of the latter for keeping said door closed, to an opening position in which said hook member, when introduced in said opening, does not match the border of the latter, so as to allow the opening of the door;

b. a retaining member mounted to move with respect to the support housing between a rest position in which it enables the hook member to be introduced into and extracted from said opening, and an operating position in which it retains the hook member, when introduced into said opening, in said closing position, so that it cannot be extracted from said opening;

c. a safety member that can move in the support housing between a retracted position, in which it enables the retaining member to move from the operating position to the rest position, and an extended position, in which it prevents the retaining member from moving from the operating position to the rest position; and d. a control device that can be electrically actuated and is adapted to control the position of said safety member;

the method including, starting from a condition in which said hook member is introduced in said opening, said retaining member is in said operating position, and said safety member is in said extended position, the following steps:

inserting a tool in said cabinet through an emergency opening provided in the latter until said tool interacts with said safety member moving the latter into said retracted position;

operating said handle and keeping it operated in such a way to try to move said hook member in said opening position, so that said hook member does not prevent said retaining member from moving towards said rest position;

removing the interaction between said tool and said safety member; and extracting said hook member from said opening.

When the door of the laundry drying and/or washing appliance is desired to be closed from an open position, the hook member of the door can be introduced into the opening of the support housing.

In proximity to the opening of the support housing, preferably also the retaining member is located. In a preferred embodiment, the retaining member includes a window in which the hook is also inserted when the door is closed.

In a known way, the arrangement of the door locking device is such that, when the door is closed, the hook member of the door engages in the opening of the support housing and in the window of the retaining member, and the latter is pushed in its operating position by a spring associated to the hook member which pushes the latter against the retaining member. In fact, the spring associated to the hook member is selected in such a way to be stronger than the spring connected to the retaining member; the latter is pushed in its operating position by the hook member.

In case it is desired to open again the door from the closed position, the handle is operated in such a way that the hook moves away from the retaining member, allowing the spring associated to the latter to make it slide into the rest position, in which the hook can then be disengaged and the door opened.

The safety member is comprised in the door opening device of the present invention, safety member which is electromechanically activated so that it can be moved along a moving direction from a retracted to an extended position, as detailed below.

In an advantageous embodiment, the movement from a retracted to an extended position of the safety member is a sliding movement and the translation of the safety member is preferably substantially perpendicular to the translation of the retaining member.

Before the hook member enters the above window, the retaining member is kept by its spring in the rest position; during the insertion of the hook member in the window, the hook member, pushed by its spring, engages the retaining member, causing it to translate, in contrast to the force exerted by of the spring, from the rest position to the operating position, so that when the hook member is introduced into the opening of the support housing and it matches the border of the latter for keeping the door closed, the retaining member is kept in the operating position by the hook member. From this condition, in order to open the door the handle has to be operated so that the hook member is moved in a direction opposite the border of the support housing, disengaging the latter and allowing at the same time the retaining member to be pushed by its spring into the rest position, in which it allows the hook member to be removed and consequently the door to be opened.

When the door is closed, and the user of the laundry washing and/or drying appliance puts the appliance into operation, a control unit of the appliance advantageously causes an actuator to be energized in a known way. As a result of this energization, the safety member moves in the extended position.

With the safety member in the extended position, a return of the retaining member to the rest position, in which it allows the door to be opened, is prevented, because the extended safety member is blocking the movement of the retaining member when the latter is in its operative position.

On completion of the operating cycle of the household appliance, a control unit of the appliance causes an energizing pulse to be sent to the actuator, to allow the door to be opened. The safety member is therefore returned to the retracted or disengaged position, in which it again allows the retaining member to be moved to the rest position in which it allows the door to be opened.

However, if a power failure or malfunctioning takes place before the control unit is able to send such an electric pulse, or any other electric signal to the actuator of the safety member, the latter remains in the extended position, blocking the retaining member in the operating position, and the door remains closed.

According to an aspect of the invention, a double security method to open the door of the appliance is thus implemented. In order to open the door when no electric signal can be sent to the safety element, or the latter is broken, in a condition in which the hook member is inserted in the opening of the support housing and it is there retained by the retaining member, with the safety member in an extended position so that the retaining member cannot move to the rest position as described above, two different operations have to be performed:

- an emergency tool has to be used in order to move the safety member to the retracted position;
- the handle has to be operated in order to allow the retaining member to be moved by its spring towards the rest position.

If the two operations are not performed, i.e. if one of those is skipped, the door remains locked. Indeed, if the tool is used in order to push the safety member in the retracted position, for example by inserting the tool into the emergency opening of the cabinet and by reaching preferably an end of the safety member which is then pushed, but the handle is not operated, as soon as the tool is removed from its location in which it engages the safety member, the handle, pushes by its spring, moves back the retaining member in its operating position, so that the safety member returns into its extended position, keeping the retaining member in its operating position and thus the door stays locked.

As mentioned, the safety member can move from the extended to the retracted position and stay in such a configuration only if is either mechanically blocked in the retracted position, for example by the action of the tool, or by means of the electric signal sent from the actuator or control unit. Thus, as soon as the tool stops to mechanically constrain the safety member, the latter returns in the extended configuration being the electrical signal absent or not working.

Vice versa, in case the handle is operated, but no tool is inserted, the hook member applies a force onto the retaining member; however, with the possible exception of a possible limited initial movement, the presence of the safety member in the extended position prevents the sliding of the retaining member into its rest position and thus prevents the opening of the door because the hook cannot be freed from the support housing.

The fact that both these operations have to be performed in order to open the door in such an emergency condition implies that accidental or involuntary opening of the door is almost impossible or at least such a risk is extremely minimized.

Preferably, said step of operating the handle of said door in such a way to try to move said hook member in said opening position, so that said hook member does not prevent said retaining member from moving towards said rest position includes the step of partially superimposing said retaining member to said safety member.

When the handle of the door is operated, the hook member disengages the retaining member, so that the latter can be slightly moved by its spring towards its rest position. The rest position however cannot be reached due to the blocking caused by the presence of the tool along the sliding direction. The slight initial shift of the retaining member however causes a partial superposition of the retaining member onto the safety member.

Preferably, one end of the safety member includes a curved or a tilted surface, so that, when the retaining member slightly slides towards the rest position in its initial movement, it can easily, for a certain length, superimpose to such tilted or curved surface of the safety member.

Advantageously, the free end of the tool can have a curved or tilted surface so that when it slides against the safety member, the latter moves towards its retracted position until the free end of the tool superimposes the safety member, keeping it in its retracted position; in a further advantageous embodiment, the same effect can be advantageously obtained even if the free end of the tool has not a curved or tilted surface (e.g. a squared surface), by making the free end of the safety member curved or having a tilted surface.

The superposition of the tool to the safety member has to be kept until the retaining member, urged towards the rest position by its spring, at least partially overlaps the safety member. In this condition, removing the tool from the safety member does not cause an automatic movement of the latter into the extended position, due to the fact that the safety member is kept in the retracted position by the retaining member overlapping it. The handle has to be kept operated until after removing the tool, otherwise the hook member would keep the retaining member in its operating position, freely the safety member; since the hook member, which is urged towards its opening position by operating the handle, does not prevent the retaining member to be moved towards its rest position by its spring, the removal of the tool allows the retaining member to be moved by its spring into the rest position, in which the hook member can be removed from the opening of the support housing, causing the opening of the door.

Advantageously, the step of removing the interaction between said tool and said safety member is performed while operating said handle in such a way to try to move said hook member in said opening position, so that said hook member does not prevent said retaining member from moving towards said rest position.

Preferably, the cabinet comprises an emergency through hole allowing the insertion of the emergency-opening tool into the cabinet and its coupling to the at least one guiding element.

The provision of an emergency hole on the cabinet allows reaching the door locking device from outside the cabinet without dismantling the whole or at least a part of the cabinet. Furthermore, the emergency hole is usually located in proximity of the position where the door locking device is mounted inside the cabinet. Thus, the emergency hole already helps the user to reach the door locking device, and particularly its guiding elements, with the emergency-opening tool.

The removal of the tool from the emergency through hole and the safety member is preferably performed while the handle is operated so that, in a preferred embodiment, the retaining member keeps the safety element in the retracted position due for example to the superposition of the retaining member and the curved or tilted surface of the safety member or of the curved or tilted surface of the retaining member and the free end of the safety member.

In an advantageous embodiment, said step of operating a handle in such a way to try to move said hook member in said opening position, so that said hook member does not prevent said retaining member from moving towards said rest position includes the step of partly shifting said retaining member towards said rest position, a further shift being blocked by said tool.

Preferably, the movements of the retaining member from/to the rest to/from the operating position are translational movements along a given direction. The translational movements of the retaining member along said given direction are allowed for a "small" length and further blocked by the presence of the tool which operates onto the safety member. The tool is positioned along the translational direction of the retaining member due to the fact that it has to operate onto the safety member that, by construction, is positioned along the sliding direction of the retaining member for its function of blocking—when commanded—such sliding from the rest to the operating position and vice-versa.

Preferably, said step of removing the interaction between said tool and said safety member includes the step of extracting said tool from said cabinet.

As mentioned, preferably the tool is inserted into the cabinet and into the support housing where the safety member is present via the emergency through hole obtained on the cabinet and on the support housing. This emergency through hole can be preferably closed by a suitable lid when the emergency through hole is not used. The emergency through hole is so located that the safety member, and preferably an end of the same, can be reached by tool insertion.

Advantageously, said step of inserting a tool in said cabinet until said tool interacts with said safety member moving the latter into said retracted position includes the step of pushing said safety member by said tool so that it retracts into said retracted position allowing said retaining member to slide in absence of said tool.

Preferably, the safety member is moved from the extracted to the retracted position by the tool which pushes the safety member into the retracted position. For example, the tool can push one end of the safety member downwards so that the safety member retracts. However, pushing of one end of the safety member can be done along any direction, for example, one end of the safety member could be pushed upwardly by the tool, or either towards the left or the right.

The relative terms "up", "down", etc. refers to the normal positioning of the appliance when installed and properly functioning.

In a preferred embodiment, said handle is mechanically connected to said hook member so as to tilt the same, and said retaining member includes a window for the insertion of said hook member, said window facing said opening of said support housing in said rest position and partly closing said opening in said operating position.

Advantageously, the step of inserting a tool in the cabinet until said tool interacts with said safety member moving the latter into said retracted position includes the step of guiding said tool until it reaches a safety member's location.

In order to "hit" the safety member easily and without a series of trial and error in order to find the safety member's position, the tool, preferably inserted in the emergency hole, is guided to the location of the safety member. Preferably, it is guided to the location of a free end of the safety member.

More preferably, the step of guiding the tool until it reaches a safety member's location includes the step of inserting the tool in one or more guiding elements formed in the door locking device directing the tool towards the safety member's location. In this way, the tool can only reach the desired location of the safety member.

In a preferred embodiment, the step of partially superimposing the retaining member to the safety member includes the step of keeping the safety member in the retracted position by means of the retaining member also in absence of the tool.

As already mentioned, the removal of the tool from the safety member is performed while the handle is operated so that the retaining member can slide towards its rest position and keeps the safety element in the retracted position due to the superposition of the retaining member and the preferably curved or tilted surface of the safety member. Thus, while the tool is removed, at the same time the handle is kept operated so that the safety member cannot move into the extended position but it is kept into the retracted position into which it has been pushed by the tool.

According to a second aspect, the invention relates to a method for an emergency opening of a door locking device of a door of a laundry washing and/or drying appliance by means of an emergency-opening tool, said appliance being provided with a cabinet containing an operative chamber in which laundry can be loaded/unloaded, said operative chamber being accessible via an access opening provided in said cabinet and closable by said door, said door locking device comprising:

a. a support housing provided internally to said cabinet and comprising an opening, accessible from outside said cabinet, for the introduction of a pivotable hook member connected to the door, said door comprising a movable handle adapted for operating said hook member in such a way to move it from a closing position, in which, when introduced in said opening, it matches a border of the latter for keeping said door closed, to an opening position in which said hook member, when introduced in said opening, does not match the border of the latter, so as to allow the opening of the door;

b. a retaining member mounted to move with respect to the support housing between a rest position in which it enables the hook member to be introduced into and extracted from said opening, and an operating position in which it retains the hook member, when introduced into said opening, in said closing position, so that it cannot be extracted from said opening;

c. a safety member that can move along a moving direction in the support housing between a retracted position, in which it enables the retaining member to move from the operating position to the rest position, and an extended position, in which it prevents the retaining member from moving from the operating position to the rest position; and d. a control device that can be electrically actuated and is adapted to control the position of said safety member;

wherein said emergency-opening tool comprises a shaft extending along a shaft axis and having a first bended end portion shaped so as to be able to cooperate with the safety member in order to move it from its extended to its retracted position and a second end portion provided with a tool handle, the method including:

inserting said emergency opening tool in said in said cabinet the bended end portion pointing a first direction different from the moving direction of the safety member; and rotating said emergency opening tool about its axis in order for the bended end portion to push the safety member towards said retracted position.

Preferably, the laundry washing and/or drying appliance further comprises at least one emergency-opening tool adapted to engage the safety member for moving it from its extended position into its retracted position.

More preferably, the at least one emergency-opening tool has a substantially elongated shape.

The elongated shape of the one emergency-opening tool advantageously allows an easy insertion of the same into the cabinet, e.g. through the emergency hole which in this case can be small, and also allows reaching a safety member location placed inside the cabinet, preferably distal to the emergency hole.

Preferably, the at least one emergency-opening tool comprises a shaft extending along a shaft axis and having a first end portion shaped so as to be able to cooperate with the safety member in order to move it from its extended to its retracted position and a second end portion provided with a handle.

The shape of the emergency-opening tool is usefully selected so that one end couples with the safety member and allows transferring to the latter a force capable of bringing it into its retracted position, applied to the other end (namely to the handle).

More preferably, the shaft comprises a bended end portion extending substantially orthogonally to the shaft axis, once having reached the safety member location following a sliding movement along the shaft axis, the shaft end portion being adapted to interact with the safety member so as to exert to the same an axial force in the direction of movement of the safety member upon rotation of the emergency-opening tool around the shaft axis.

Advantageously, according to the above defined very simple and inexpensive embodiment of an emergency-opening tool which easily allows transferring force to the safety member in order to bring it into its retracted position, a bended end portion of the shaft is provided.

Preferably, the at least one emergency-opening tool is initially coupled to the support element by inserting it into the elongated recess.

More preferably, the at least one emergency-opening tool is rotated about its axis in order for the bended end portion to substantially point a first direction different from the moving direction of the safety member.

Even more preferably, the at least one emergency-opening tool is moved axially until the safety member location is reached and then rotated about its axis in order for the bended end portion to push the safety member towards the inside of the support housing.

The above actions are easily and rapidly performed. In every step the emergency-opening tool is guided and/or supported by the guiding element, so that the safety member location is easily found and reached. Thus, the safety member is brought into it retracted position without loss of time or difficulty.

Preferably, said door locking device comprises at least one guiding element provided in said support housing and said step of inserting said emergency opening tool in said in said cabinet includes guiding said emergency-opening tool to said safety member location from which the safety member extends when it is in its extended position.

In this preferred embodiment, the support housing of the door locking device of the laundry washing and/or drying appliance is provided with at least one guiding element for guiding the emergency-opening tool to the safety member location. In this way, the emergency-opening tool which is inserted into the laundry washing and/or drying appliance usually in proximity to the door locking device, immediately engages the guiding element provided on the support housing of the same and is guided to the safety member.

In fact, preferably a force applied by the user makes the emergency-opening tool to slide along the guiding element until it reaches the safety member location, almost irrespective of the precise direction along which the force is applied. Therefore, it becomes very easy for a user to rapidly and easily reach the safety member location with the emergency-opening tool.

More preferably, said at least one guiding element provided in said support housing includes a bended portion and, before the step of rotating said emergency opening tool about its axis, the method of the invention includes abutting said bended end portion of said tool onto said bended portion of said guiding element.

In a preferred embodiment, the at least one guiding element comprises at least one stop element limiting a sliding movement of the emergency-opening tool within the guiding element, the stop element being substantially positioned at the safety member location. The stop element is the bended portion of the guiding element.

The provision of a stop element at the safety member location usefully helps the user to understand when the insertion of the emergency-opening tool has been completed and the safety member location has been reached. Therefore, the user understands when the tool can be operated in order to act on the safety member.

Alternatively, according to a further advantageous embodiment, the at least one emergency-opening tool comprises a shaft extending along a shaft axis and, at a first end portion, having a shape substantially matching the shape of an upper surface of the safety member and capable of exerting an axial force in the direction of movement of the safety member when the emergency-opening tool is axially moved along the shaft axis. Also according to this further advantageous embodiment, a force is easily transferred to the safety member in order to bring it into its retracted position.

BRIEF DESCRIPTION OF THE DRAWINGS

With reference to the attached drawings, further features and advantages of the present invention will be shown by means of the following detailed description of some of its preferred embodiments. According to the above description, the several features of each embodiment can be unrestrictedly and independently combined with each other in order to achieve the advantages specifically deriving from a certain combination of the same.

In the said drawings.

DETAILED DESCRIPTION OF EXAMPLE EMBODIMENTS

Figures 1A, 1B:
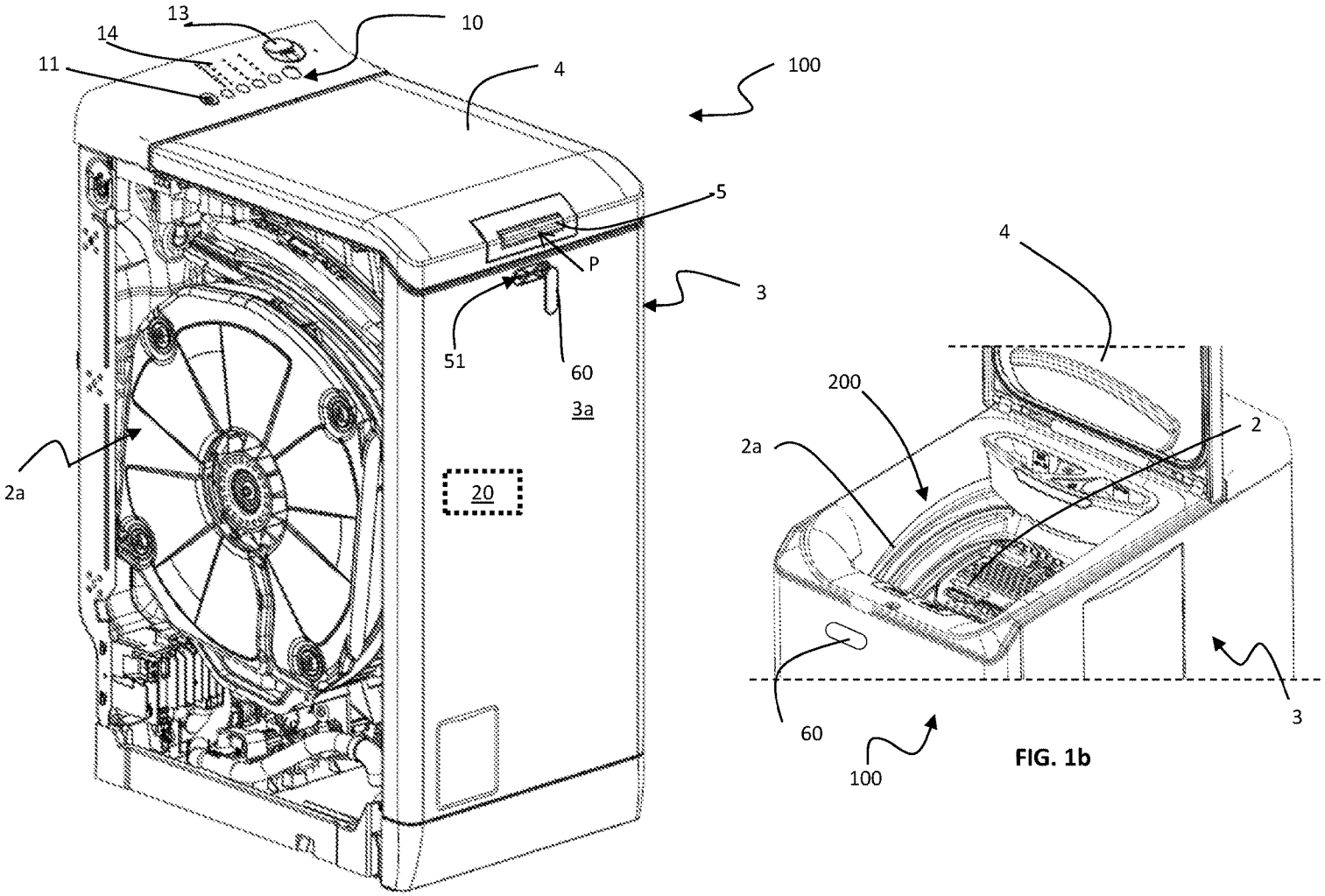
FIG. 1*a* is a perspective view of a laundry washing machine in accordance with the present invention, with a portion of the cabinet removed, with the door in a closed condition.
FIG. 1*b* is a perspective view of a part of the laundry washing machine of FIG. 1*a*, with the door in an opened condition.

In FIG. 1*a* a laundry washing or drying appliance according to the present invention is globally indicated with 100. The appliance is in this non limitative example a top loading washing machine, however the present invention is applicable to generic washing machines, dryers and washer-dryers as well, regardless whether they are top loading or front loading.

The machine 100 advantageously includes a washing tub 2*a*, containing a rotatable drum 2, where laundry can be loaded and unloaded. Tub 2*a* and drum 2 are contained in a cabinet 3 having a loading/unloading cabinet opening 200 closed by a door 4 movably connected, e.g. hinged in the advantageous embodiment of attached figures, to the cabinet 3. Cabinet 3 is for example but not necessarily parallelepiped-shaped and includes a front wall 3*a*. Door 4 can be opened and possibly closed by means of a handle 5.

Figure 4:
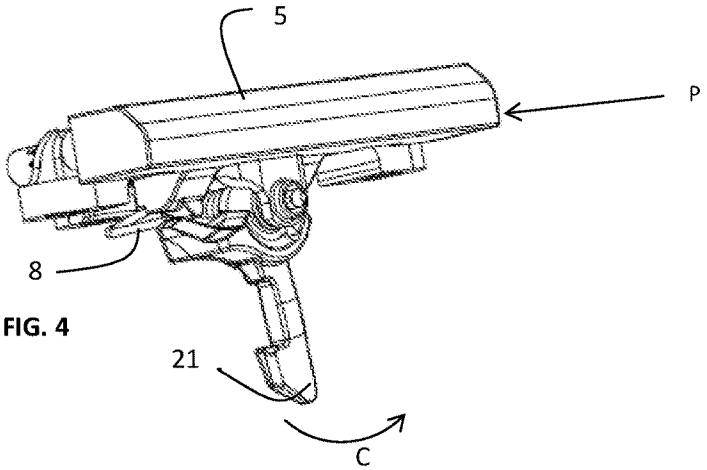
FIG. 4 is a perspective enlarged view of the handle and the hook member of the laundry washing machine of FIG. 1.

Handle 5 can be for example of the pivoting type, i.e. it can be operated by rotating it with respect to the door 4, or it can be advantageously of the "pushing type", i.e. it can be operated by pushing it in such a way to slide it with respect to the door 4; in the embodiment illustrated in attached figures, handle 5 is of the "pushing type", so it can be operated by pushing it in the direction illustrated by arrow P in FIGS. 1*a* and 4. Washing tub 2*a* is advantageously connected or connectable to water mains, by means of a water inlet (not shown in the figures). In case of a dryer, both the washing tub and such a connection are not present.

The washing machine 100 advantageously includes a control panel 10 apt to be used by a user for example to set parameters of operating programs (e.g. temperature, number of rinsing cycles, speed of spinning, etc.) and/or to select an operating program from a given list, through suitable push buttons 11 or knobs. Moreover, control panel 10 includes preferably a display 13 and one or more light elements 14. In case of a top loading washing machine, the control panel 10 is preferably located at the top of the appliance 100, however any other location is encompassed in the present invention.

The washing machine 100 is preferably programmed to function according to the one or more operating (washing in the case of a washing machine) programs. These programs include for example a wool program, a cotton program, a quick program, etc.

Figure 3:
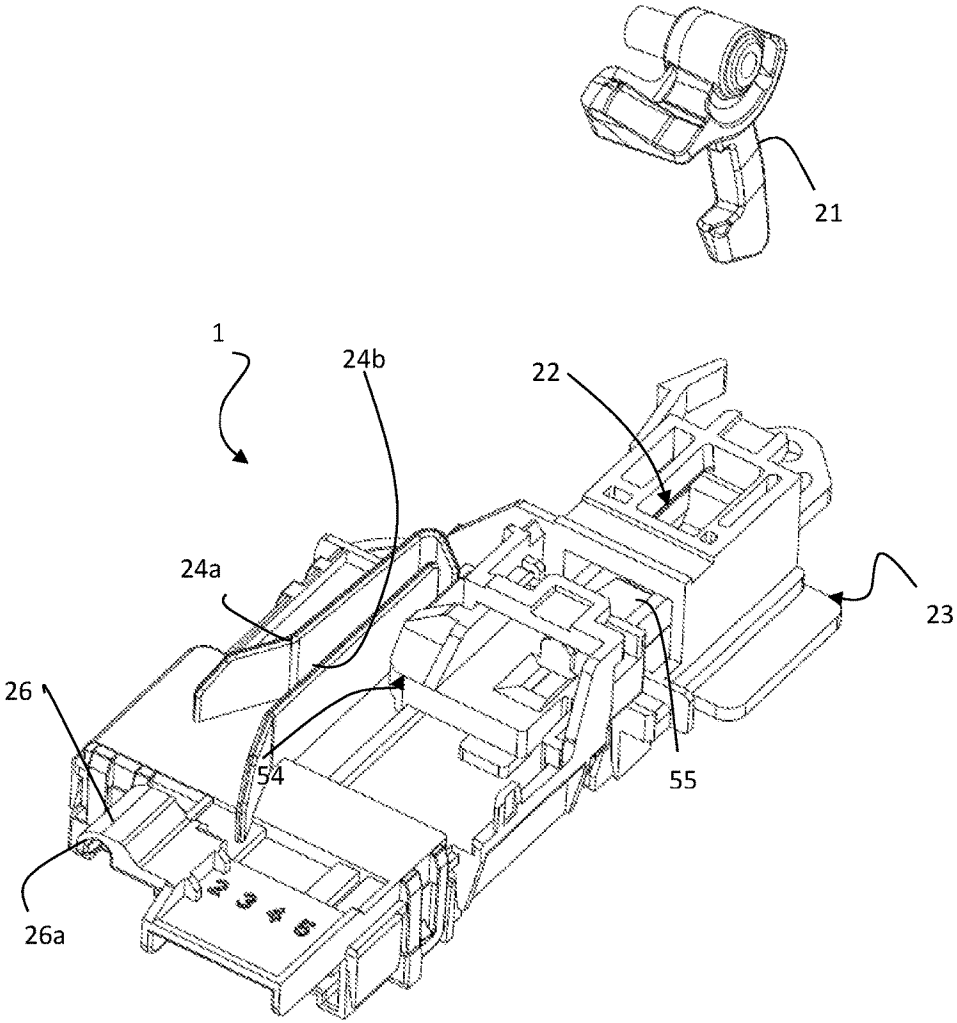
FIG. 3 is a perspective view of the door locking device of FIGS. 2*a* and 2*b* and of a detail of the washing machine of FIG. 1.

The cabinet door 4 is provided with a hook member 21, visible for example in FIGS. 3 and 4, adapted to engage with a door locking device 1 installed inside the cabinet 3 so as to be accessible from outside the same 3.

The door locking device 1 comprises a support housing 23 provided with an opening 22 for the introduction of the hook member 21. The housing opening 22 is accessible from outside the cabinet 3.

The handle 5 is adapted for operating the hook member 21 in such a way to move it from a closing position (in which the hook member 21 is advantageously pushed by a resilient device, such as a spring 8) to an opening position. In the advantageous embodiment illustrated in attached drawings 2*a*, 2*b* and 3, by pushing the handle 5 in the direction indicated by arrow P in FIGS. 1*a* and 4, the hook member 21, which is normally pressed by resilient device 8 in its closing position, is moved in the direction indicated by arrow C in FIG. 4, until it reaches its opening position.

Figure 2A:
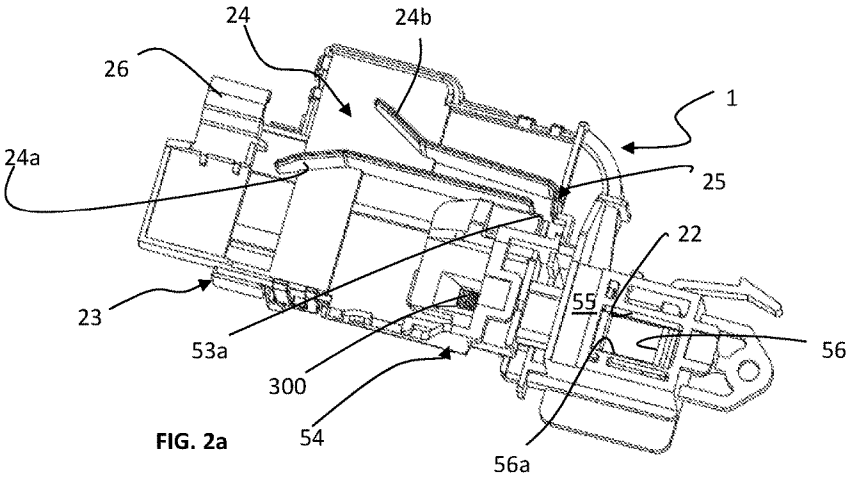
FIG. 2*a* and FIG. 2*b* are two perspective views of a door locking device according to the invention in a first and a second configuration, respectively.
Figure 2B:
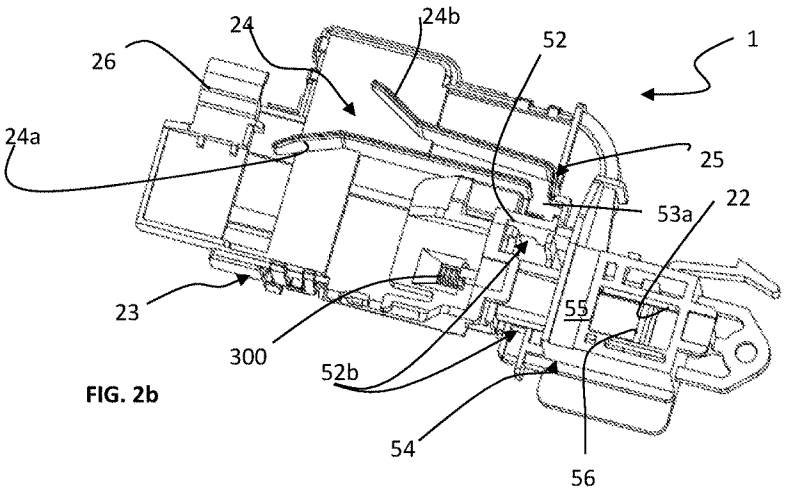

The door locking device 1, with now reference to FIGS. 2*a*, 2*b* and 3, comprises a retaining member 54 mounted to move with respect to the support housing 23 between a rest position (depicted in FIG. 2*a*) in which it enables the hook member 21 to be introduced into and extracted from the housing opening 22 and an operating position (depicted in FIG. 2*b*) in which it retains the hook member 21 in a closing position, when the hook member 21 is introduced into the housing opening 22.

Figure 8B:
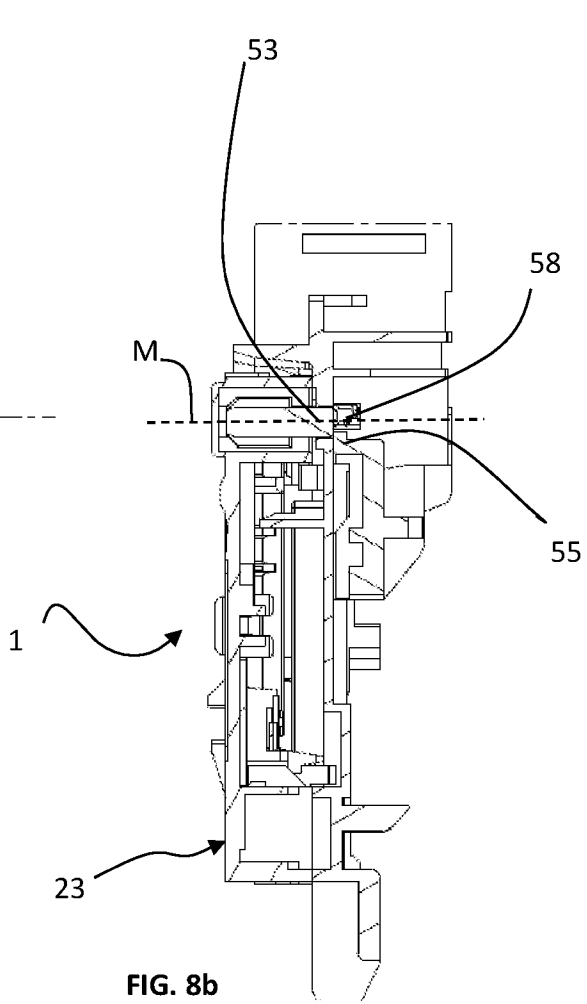
FIG. 8*b* is a cross section taken along to plane VIII-VIII of FIG. 8*a*.
Figure 8A:
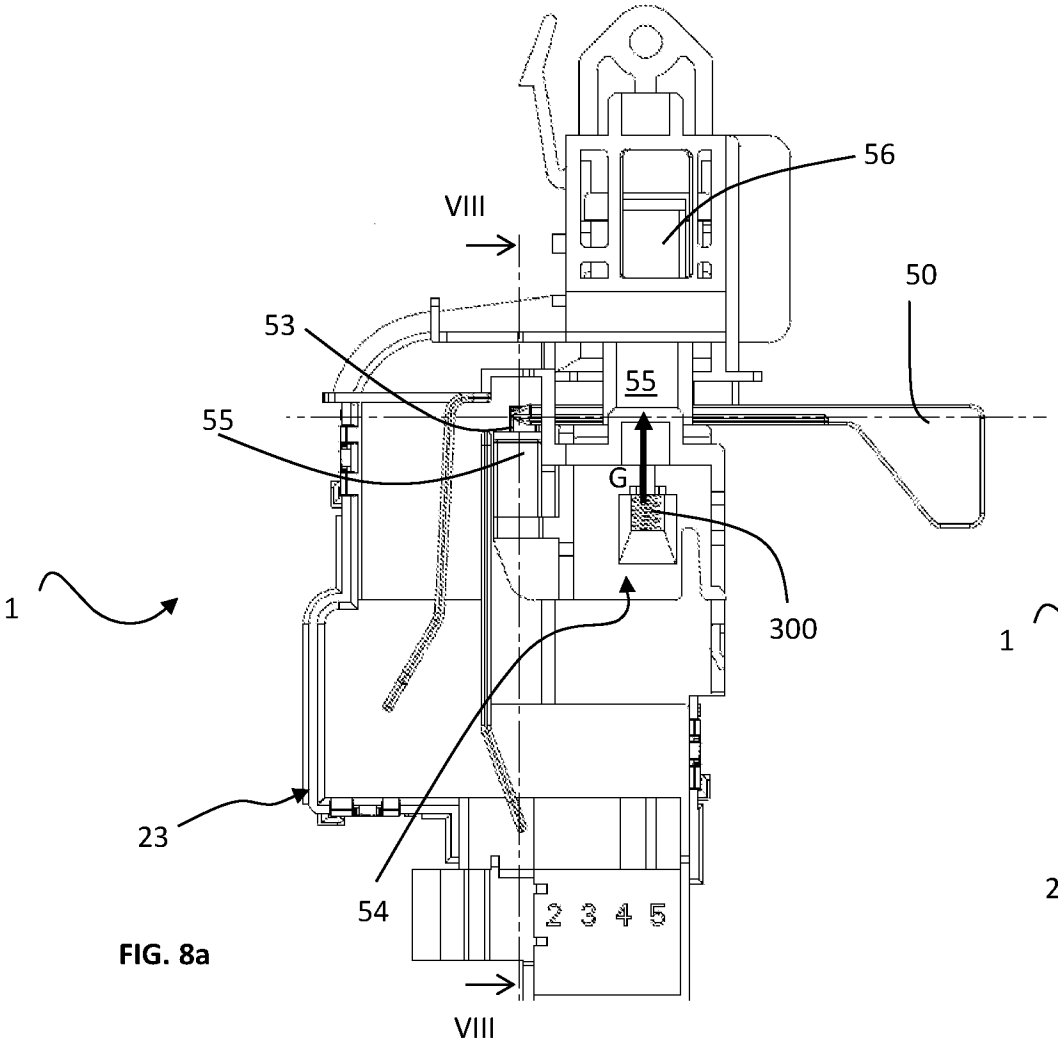
FIG. 8*a* is a top view of the door locking device of FIGS. 1 and 2*a*-2*b*, in an additional phase of the method of the invention.
Figure 9A:
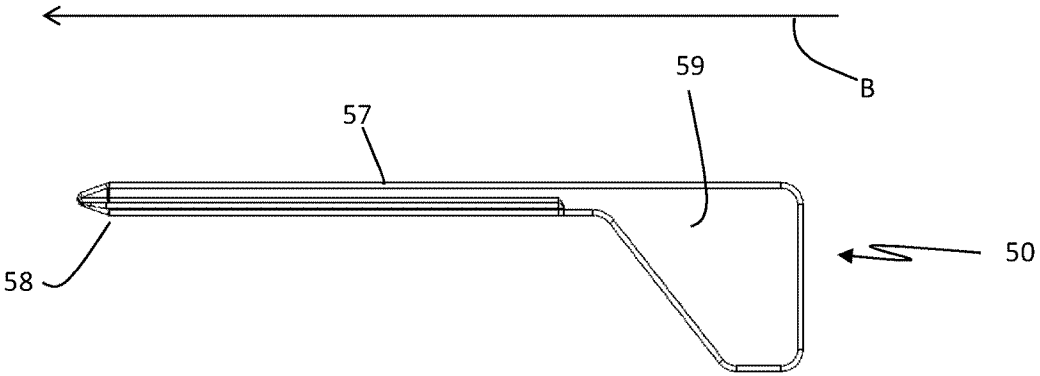
FIG. 9*a* and FIG. 9*b* are a side and a perspective view of an emergency-opening tool respectively.
Figure 9B:
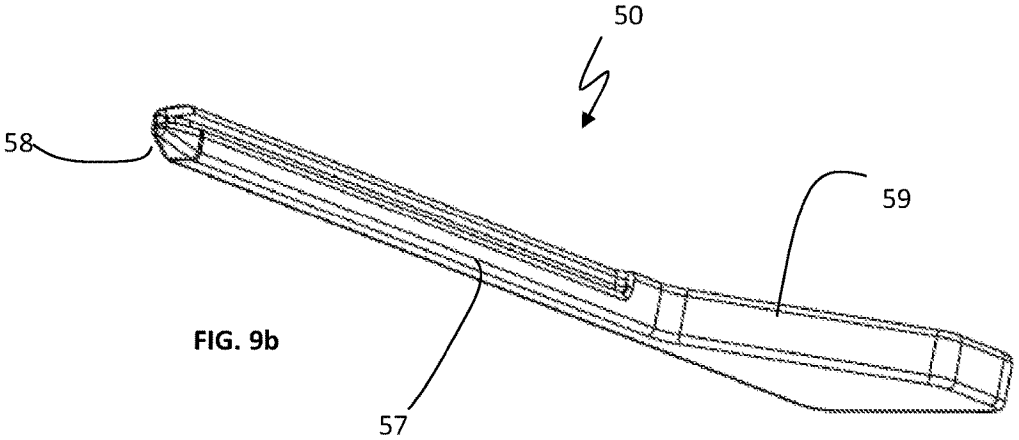

Advantageously, the retaining member 54 is operatively connected to a spring 300 (shown only in FIGS. 2*a*, 2*b* and 8*a*), interposed between the retaining member 54 and the support housing 23 and arranged in such a way to exert a force, schematically illustrated in FIG. 8*a* with arrow "G", which tends to push the retaining member 54 towards its rest position.

The retaining member 54 comprises a slider 55 provided with a window 56. When the retaining member 54 is in its rest position, the window 56 is substantially aligned with the housing opening 22, as shown in FIG. 2*a* in which boundary 56*a* of window 56 and boundary of housing opening 22 are substantially coinciding, thereby allowing the hook member 21 to be introduced into and extracted from the housing opening 22. In the operating position, boundary of window 56 and of opening 22 are not superimposed any more, blocking the hook inserted in the housing 23 from exiting the opening 22.

Preferably, the movement of the retaining member 54 from the rest position to the operating position is a sliding movement along a sliding direction indicated with X in the drawings.

In the closing position, the hook member 21 introduced into the housing opening 22 matches the edge of the support housing 23 defining the housing opening 22. In this way the door is kept closed 4.

In the opening position, the hook member 21 introduced in the housing opening 22, does not match the edge of the housing 23, allowing the extraction of the hook member from the housing opening 22 and thus the opening of the door 4.

The door locking device 1 further comprises a safety member 53 that can move along a moving direction (shown in FIG. 8*b* with axis "M") in the housing 23 between a retracted position, in which it enables the retaining member 54 to move from the operating position to the rest position, and an extended position, in which it prevents the retaining member 54 from moving from the operating position to the rest position.

Preferably, the movement of the safety member 53 from a retracted to an extended position is an axial movement along a direction substantially perpendicular to the sliding direction of the retaining member. In this way, when the safety member is in the extended position, and the retaining member 54 is in its operating position, the retaining member 54 is blocked in its sliding and it remains in the operating position.

The door locking device 1 also comprises an electrically powered control element or control device 20 (schematically depicted in FIG. 1*a*) housed inside the housing 23 and adapted to control the position of the safety member 53.

The door locking device 1 shown in FIGS. 2*a* and 2*b* further comprise a plurality of guiding elements adapted to guide an emergency-opening tool 40,50 to a safety member location 53*a*, namely to the position from which the safety member 53 extends from the housing 23 when it is in its extended position.

Emergency opening tool 40,50 is in the following named "service tool" 40 in case a tool generally operated by a professional service of the appliance is meant, and "user tool" when the tool is supposed to be used by a user of the appliance. However, these names are not limiting and the service tool could be operated by the user and the user tool by the service as well. In both cases, user tool 50 and service tool 40 are used for an emergency opening of the door locking device 1.

Although in the following the emergency opening of the door locking device is described with reference to both the user and the service tool 40, 50, it is to be understood that also only one of these tools can be present in an embodiment of the present invention. Therefore, the door opening device 1 can be opened in an emergency opening by the service tool 40, by the user tool 50 or by both, depending on the specific embodiment chosen.

Accordingly, the guiding elements present in the door opening device 1 can vary in number and/or position depending on the tool which is supposed to open the device 1 in an emergency opening. In the following, both a first and a second guiding element will be described, however one of these, or both, can be present in the appliance of the invention.

The guiding elements include a first guiding element 24,26 which comprises a couple of walls 24*a*,24*b* which project from the support housing 23 substantially parallel to the direction of movement of the safety member 53. The two walls 24*a*,24*b* also extend substantially parallel to each other for a portion, so as to define a linear guiding channel.

Figure 5A:
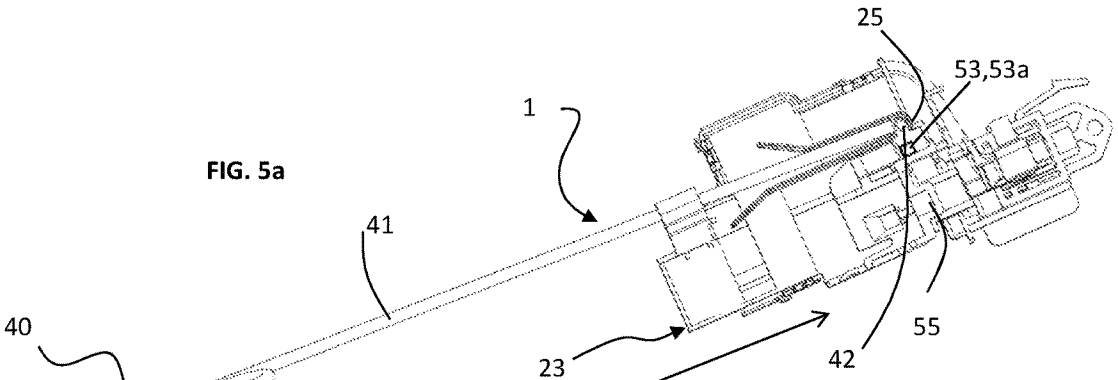
FIG. 5*a* and FIG. 5*b* are two perspective views of the door locking device of FIG. 1 and FIGS. 2*a*-2*b* with a first kind of tool inserted therein, in a first and a second phase of the method of the invention, respectively.
Figure 5B:
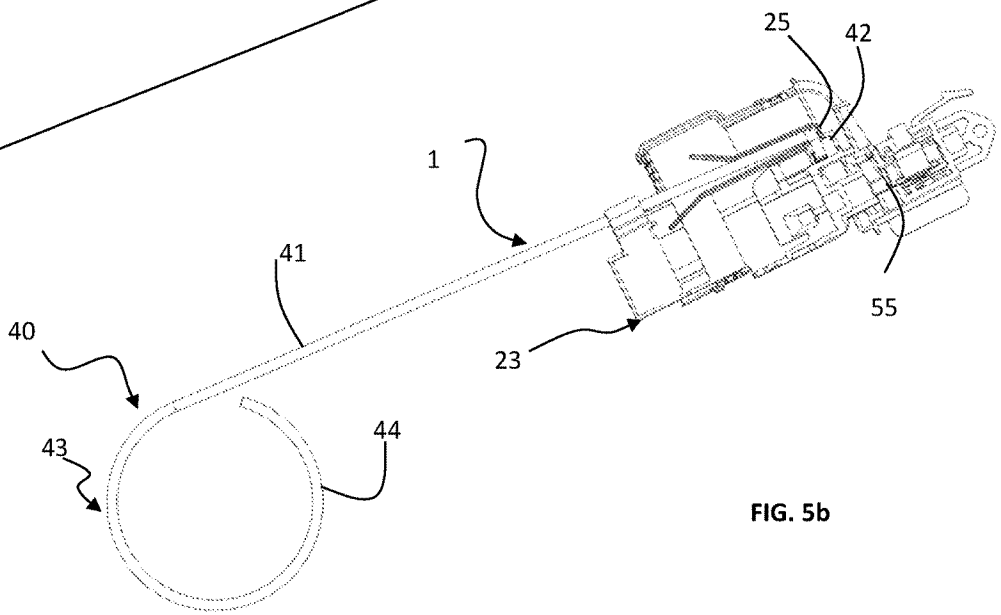

At a first end distal to the safety member location 53*a*, the two walls diverge from each other so as to define a guide access portion in the shape of a funnel, thereby simplifying the entrance of a first tool 40 shown in FIGS. 5*a* and 5*b*, e.g. a service tool, inside the channel when an emergency opening needs to be performed, as detailed below.

At a second end proximal to the safety member location 53*a*, one first 24*a* of the two walls 24*a*,24*b* has a bended portion which defines a stop element 25 limiting a sliding movement of the service tool 40 within the first guiding element 24,26, when such a tool 40 is inserted in the guiding element 24,26. The stop element 25 identifies the arrival of the service tool 40 at the safety member location 53*a*, i.e. when the service tool 40 hits the bended portion 25 of the first wall 24*a* the user understands that the service tool 40 has reached the safety member location 53*a* and that the sliding run of the service tool 40 has ended. The service tool 40 can thus be operated in order to act on the safety member 53.

At the first end distal to the safety member location 53*a*, the guiding element 24,26 comprises a support element 26 which is provided with an elongated recess 26*a* defining a sliding support guide for the service tool 40. The service tool 40 engages in the sliding support guide 26*a* by shape coupling. Upon engagement, the services tool 40 is retained inside the recess 26*a* but is free to slide in a shaft direction A described below.

The service tool 40 has a substantially elongated shape. It comprises a shaft 41 extending along a shaft axis A with a first end portion 42 shaped so as to be able to cooperate with the safety member 53 in order to move it from its extended to its retracted position. Preferably the service tool 40 comprises a second end portion 43, preferably provided with a handle 44. The handle 44 of the service tool 40 is preferably defined by a ring curved end portion 43 of the shaft 41. At the first end portion 42, the shaft 41 is bended so that the end portion 42 extends substantially orthogonally to the shaft axis A.

The service tool 40 is initially coupled to the support element 26 by inserting it into the elongated recess 26*a*. The service tool 40 is then rotated about its shaft axis A, for example operating its handle 43, in order for the bended end portion 42 to substantially point upwards. Then, the service tool 40 is axially moved along the shaft direction A until it hits the bended portion 25 of the first wall 24*a* which signalizes that the safety member location 53*a* is reached (this condition is shown in FIG. 5*a*). At this point, the service tool 40 is rotated about its shaft axis A in order for the bended end portion 42 to push the safety member 53 towards the inside of the support housing 23 (this condition is shown in FIG. 5*b*).

A second guiding element comprises at least one through opening 52*b* in a housing wall 52 which extends substantially parallel to the direction of movement of the safety member 53. The at least one through opening 52*b*, preferably together with an emergency hole 51 provided in the cabinet front wall 3*a*, defines a linear guide for a second emergency-opening tool 50, e.g. a user tool. Preferably, the opening 52*b* faces the safety member location 53*a*.

Preferably, as shown in FIG. 2*b*, second guiding element comprises a plurality of through openings 52*b* distributed between the emergency hole 51 provided on the cabinet 3 and the safety member location 53*a* provided on the door locking device 1.

Preferably, the emergency hole 51 provided in the cabinet wall 3*a* is hidden behind a removable lid 60.

The user tool 50 preferably comprises a shaft 57 which extends along a shaft axis B and, at a first end portion 58, it has preferably a shape substantially matching the shape of an upper surface of the safety member 53 in order to exert an axial force in the direction of movement of the safety member 53 when the emergency tool 50 is axially moved along the shaft axis B. For instance, the first end portion 58 of the tool can be tapered and the upper surface of the safety member 53 can be flat or vice versa.

At a second end portion, the user tool is preferably provided with a handle 59. The user tool 50 can be inserted through the holes 51,52*b* in order to reach the safety member location 53*a*.

In a further, not shown, advantageous embodiment of the guiding elements, the support housing 23 comprises one or more elongated grooves defining guiding channels into which the tools 40,50 slide. The grooves are preferably provided in an outer surface of the support housing 23 of the door locking device 1.

In case of a sudden power failure, the door locking device 1 remains in the locked configuration, where the hook 21 of door 4 is trapped in the opening 22 of support housing 23. The actuator (not visible in the appended drawings) cannot receive an electronic signal from the control unit 20 in order to move the safety member 53 from the extended to the retracted position; in this condition the retaining member 54 can't be moved to its rest position, and therefore it keeps the hook 21 in its closing position, and the door 4 can't be opened by operating the handle 5. Indeed, operation of handle 5 simply applies, via hook 21, a force onto the retaining member 54, which cannot slide due to the safety member presence along the sliding direction of retaining member 54 to the rest position.

In order to open the door 4 of the appliance 100, the following method having a double security is advantageously used according to the invention.

Figure 6:
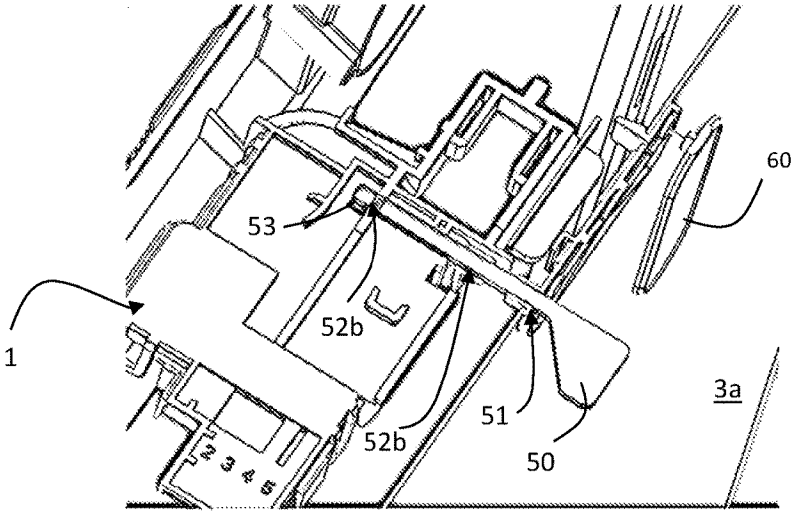
FIG. 6 is a perspective view of a portion of the laundry washing machine and of the door locking device of FIG. 1 and FIGS. 2*a*-2*b* with a second tool inserted therein, respectively, in a phase of the method of the invention.

After removing removable lid 60, if present, user tool 50 is inserted into emergency hole 51 provided on the front panel 3*a* of cabinet 3. Suitable guides 52,52*b* guide tool 50 to the location 53*a* of the free end of the safety member 53. Guides 52, 52*b* have been described in connection to the door locking device 1 in the description made above. The tool 50 therefore, substantially upon insertion, reaches the safety member 53 without any trial and error search of the safety member's position. The length of tool 50 is suitably chosen so that reaching the safety member 53 location is possible. This step is depicted in FIG. 6.

Figure 7A:
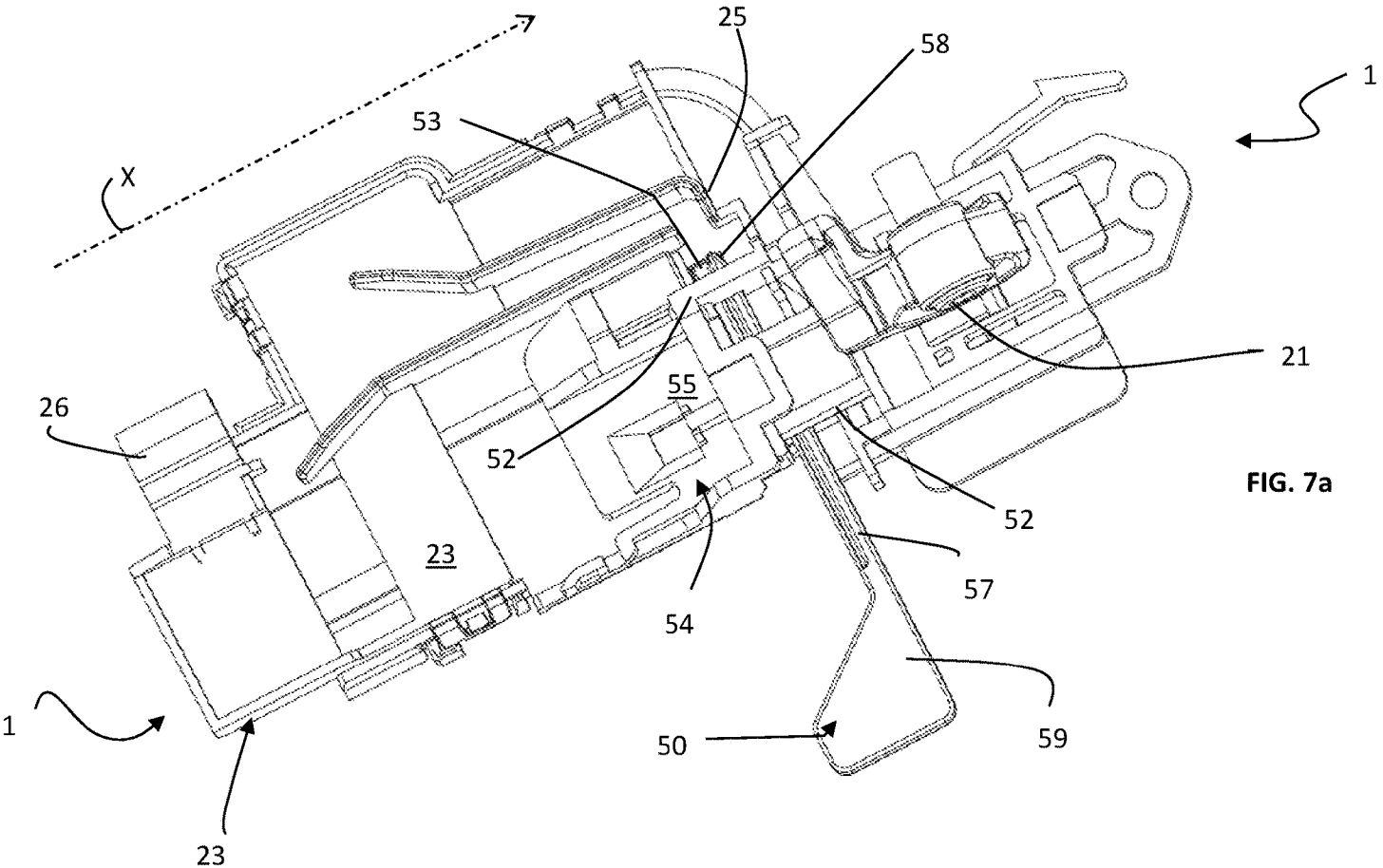
FIG. 7*a* and FIG. 7*b* are two perspective views from above and from below of the door locking device of FIGS. 2*a* and 2*b* in the phase of the method of the invention of FIG. 6.

The inserted tool 50 pushes the free end of the safety member 53, having a pin shape, so that it moves from the extended to the retracted configuration, as shown in greater details in FIG. 7*a*. In this embodiment, tool 50 pushes safety member 53 downwards.

Due to the presence of the tool 50, retaining member 54 cannot slide back to the rest position although safety member 53 is now not present any more in the sliding direction X of the retaining member 54.

Figure 7B:
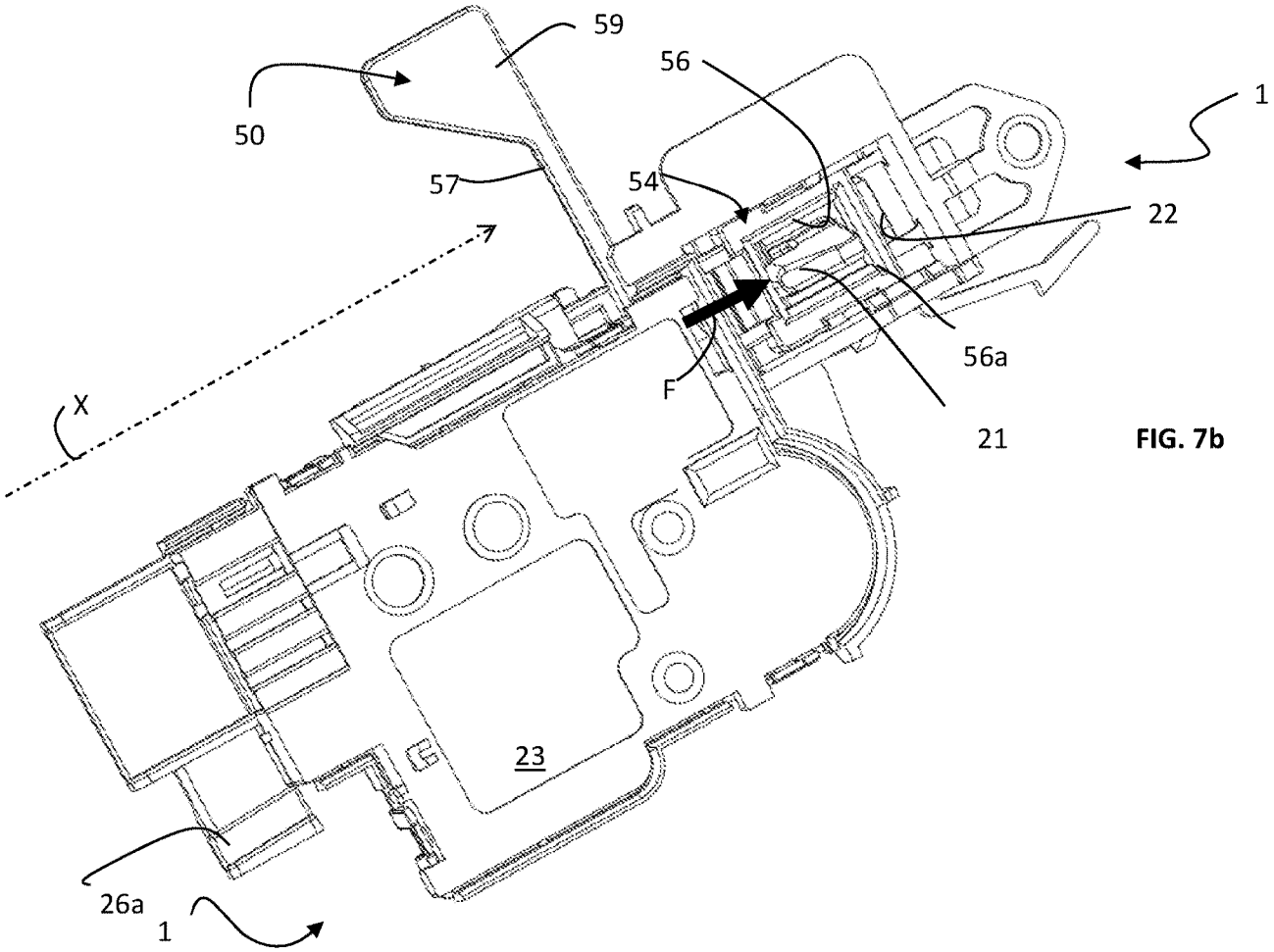

Therefore, in order to open door 4, a further step of the method of the invention is performed. Handle 5 is operated in order to move hook member 21. The operation of handle 5 rotates hook 21 as depicted in FIG. 4 in the direction indicated by arrow numbered "C" in FIG. 4. Hook 21 and handle 5 are mechanically connected in such a way that, upon operation of the handle, the hook pivots and rotates. In such a rotation, the hook member 21 moves in a direction (indicated by arrow F in FIG. 7*b*) opposite to the border of the support housing it was matching and allows the retaining member 54 to move in the same direction, pushed by spring 300, towards its rest position along the X axis.

The slider 55 of retaining member 54, due to the action of spring 300, partially shifts along the X axis towards the rest position, but in its sliding it is stopped by the presence of tool 50 that prevents further sliding, apart from a possible slight initial movement.

However the slider 55, at least for a certain length, superimposes the safety member 53, so that a portion of the safety member 53 is covered by slider 55. As visible in FIGS. 8*a* and 8*b*, the reciprocal shape of safety member 53, and in particular of its free end, and the slider 55 facilitates the superposition of the latter onto the free end for a small portion of the same, while the tool 50 is still inserted and pressing the free end of the safety member 53.

As soon as a portion of the free end of the safety member 53 is covered by slider 55, the tool 50 can be removed from its interaction with the safety member 53. However, during the extraction of the tool 50 from the support housing 23 and the emergency hole 51, the handle 5 has still to be operated so that the hook member 21 is kept in its opening position and it does not prevent the retaining member 54 from moving towards its rest position, pushed by the spring 300; if the handle were not operated during the removal of the emergency tool 50, the retaining member 54 would be moved back to its operating position by the hook member 21 and the safety member 53 would return to the extended configuration, impeding again the opening of the door. As soon as the tool 50 is removed, and the handle 5 still kept operated, the sliding of the retaining member 54 is not hindered any more, the safety member 53 becomes completely covered by slider 55 and thus blocked into the retracted position. In this condition the hook 21 can be removed from the support housing 23, and the door opened.

The invention claimed is:

1. A method for an emergency opening of a door locking device of a door of a laundry washing and/or drying appliance provided with a cabinet containing an operative chamber in which laundry can be loaded/unloaded, said operative chamber being accessible via an access opening provided in said cabinet and closable by said door, said door locking device comprising:

a. a support housing provided internally to said cabinet and comprising an opening, accessible from outside said cabinet, for the introduction of a pivotable hook member connected to the door, said door comprising a movable handle adapted for operating said hook member in such a way to move it from a closing position, in which, when introduced in said opening, the hook member is engaged with an edge of said support housing for keeping said door closed, to an opening position in which said hook member, when introduced in said opening, is not engaged with the edge of said support housing, so as to allow the opening of the door;

b. a retaining member mounted to move with respect to the support housing between a rest position in which it enables the hook member to be introduced into and extracted from said opening, and an operating position in which it retains the hook member, when introduced into said opening, in said closing position, so that it cannot be extracted from said opening;

c. a safety member that can move along a first axis in the support housing between a retracted position, in which it enables the retaining member to move from the operating position to the rest position, and an extended position, in which it prevents the retaining member from moving from the operating position to the rest position; and d. a control device that can be electrically actuated and is adapted to control the position of said safety member;

the method including, starting from a condition in which said hook member is introduced in said opening, said retaining member is in said operating position, and said safety member is in said extended position, the following steps:

inserting a tool in said cabinet along a second axis until said tool interacts with said safety member moving the safety member along the first axis into said retracted position, wherein the second axis is different than and intersects the first axis;

operating said handle and keeping it operated to move said hook member in said opening position while the tool is inserted into said cabinet and interacting with said safety member, so that said hook member does not prevent said retaining member from moving towards said rest position;

removing the interaction between said tool and said safety member; and removing said hook member from said opening.

2. The method according to claim 1, wherein said step of operating the handle of said door in such a way to try to move said hook member in said opening position, so that said hook member does not prevent said retaining member from moving towards said rest position, includes partially superimposing said retaining member to said safety member.

3. The method according to claim 2, wherein said step of partially superimposing said retaining member to said safety member includes the step of keeping said safety member in said retracted position by means of said retaining member also in absence of said tool.

4. The method according to claim 1, wherein said step of operating a handle in such a way to try to move said hook member in said opening position, so that said hook member does not prevent said retaining member from moving towards said rest position includes the step of partly shifting said retaining member towards said rest position, a further shift being blocked by said tool.

5. The method according to claim 1, wherein said step of removing the interaction between said tool and said safety member includes the step of extracting said tool from said cabinet.

6. The method according to claim 1, wherein said step of inserting a tool in said cabinet until said tool interacts with said safety member moving the safety member into said retracted position includes the step of pushing said safety member by said tool so that it retracts into said retracted position.

7. The method according to claim 1, wherein said handle is mechanically connected to said hook member so as to tilt the same, wherein said retaining member includes a window for the insertion of said hook member, said window facing said opening of said support housing in said rest position and partly closing said opening in said operating position.

8. The method according to claim 1, wherein said step of inserting a tool in said cabinet until said tool interacts with said safety member moving the safety member into said retracted position includes the step of guiding said tool until it reaches said safety member.

9. The method according to claim 8, wherein said step of guiding said tool until it reaches said safety member includes the step of inserting said tool in one or more guiding elements formed in said door locking device directing said tool towards said safety member.

10. The method according to claim 1, wherein the second axis is perpendicular to the first axis.

11. The method according to claim 1, wherein the safety member is moved along the first axis into the retracted position by a tapered end of the tool.

* * * * *